US005946862A

United States Patent [19]

Hoffman

[11] Patent Number: 5,946,862

[45] **Date of Patent: *Sep. 7, 1999**

[54] ROOF FLASHING STRIP AND METHOD OF PRODUCTION

[76] Inventor: Kenneth S. Hoffman, 24734 Orchid, Harrison Township, Mich. 48045

[ * ] Notice: Under 35 U.S.C. 154(b), the term of this patent shall be extended for 114 days.

[21] Appl. No.: 08/540,548

[22] Filed: Oct. 6, 1995

[51] Int. Cl.[6] ..... E04D 1/36

[52] U.S. Cl. ..... 52/58; 52/60

[58] Field of Search ..... 52/58, 60, 59, 52/61, 62, 416

[56] References Cited

U.S. PATENT DOCUMENTS 4,594,818 6/1986 Prestidge ..... 52/58

5,337,526 8/1994 Hartman ..... 52/58

5,381,632 1/1995 Damron ..... 52/58

*Primary Examiner*—Creighton Smith

*Attorney, Agent, or Firm*—Weintraub & Brady, P.C.

[57] ABSTRACT

A flashing strip for use in providing waterproofing for roofing, more particularly for use at the intersection of a vertical wall and an angled roof top. The flashing strip of the present invention includes a plurality of flashing cards pre-assembled and bent into an "L-shaped" configuration. Each of the plurality of flashing cards barred to an adjacent a card to form the flashing strip of the present invention.

9 Claims, 1 Drawing Sheet

FIG 1
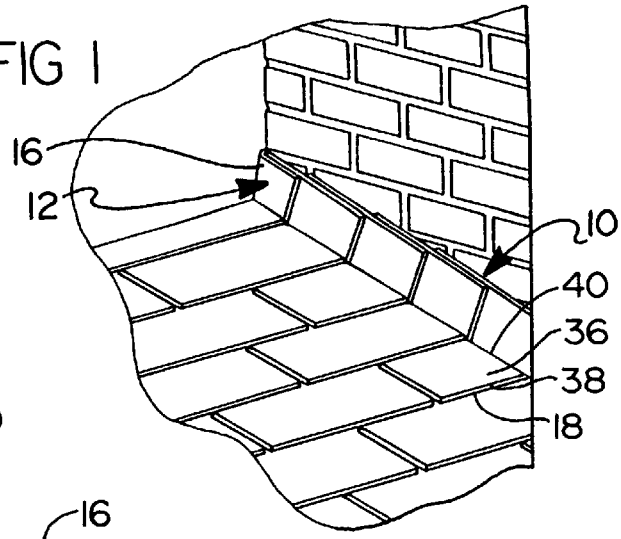
FIG 2
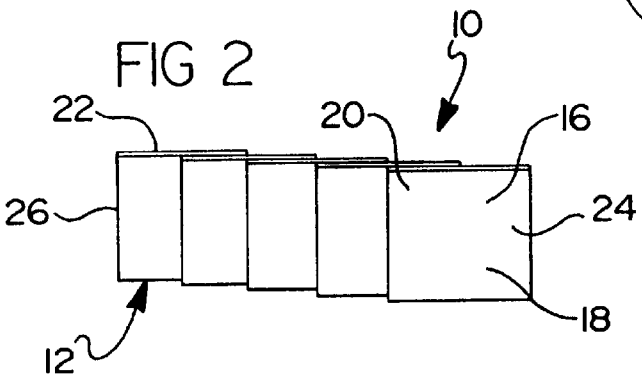
FIG 4
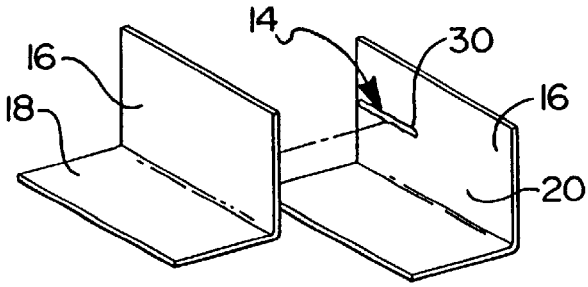
FIG 5
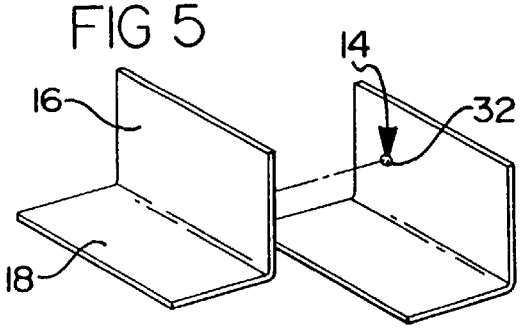
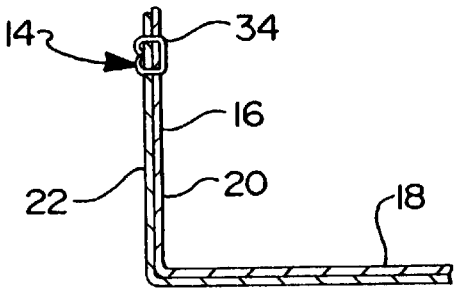
FIG 6
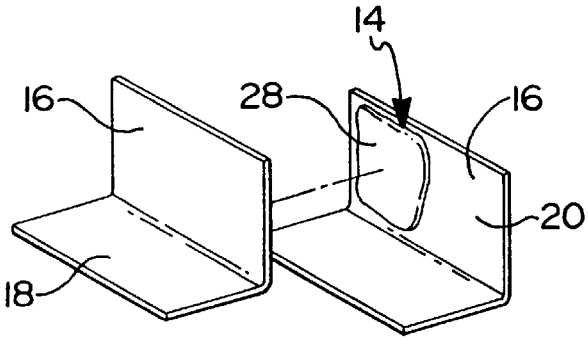
FIG 3

ROOF FLASHING STRIP AND METHOD OF PRODUCTION

BACKGROUND OF THE INVENTION

1. Field of the Invention

The present invention relates to roof flashing. More particularly, the present invention relates to roof flashing that is prefabricated. Even more particularly, the present invention provides a sizeable prefabricated roof flashing strip that is configurable for a variety of uses.

2. Description of the Prior Art

The tendency for water from rain or snow to seep into every available crack and crevice of a shingled roof is a problem which has plagued many an unfortunate home or office dweller. This problem is particularly acute at the intersection of an inclined roof slope and an upright wall or chimney structure. Water tends to seep down along the upright wall or chimney structure, bypassing the roof, and finding its way along the rafters and interior ceilings. The damage resulting from such seepage may be severe, and often results in rotted wood or damaged plaster or plasterboard. Repair costs of these elements of a structure are generally high.

Conventional responses to such seepage include the adaptation of aluminum sheet metal, known as "flashing", to the intersected areas. This flashing is fitted to the joints and angles before shingles are installed. Conventional flashing is L-shaped in cross section and is sold as "flashing cards".

The horizontal part of a flashing card is nailed, by means of roofing nails to the wood on a roof before the shingle is applied. A roofer alternates between securing a flashing card to the roof and laying a shingle over the horizontal portion of the flashing card. The vertical portion of the "L-shaped" flashing card may be nailed to the upright surface against which it abuts. Alternatively, it may be attached via a tar-based adhesive.

Currently, roofers use flashing cards and shingles to provide weather protection for and insulation of the roofs of buildings. Flashing, when used in roofing, is designed to manipulate the flow of water in a certain direction on the roof. Flashing also protects sections of a building where the shingles abut a wall or an edge. Commonly, flashing is used adjacent to house chimneys. Flashing is also used when the building has more than one roof level. For example, a garage has a roof lower than the roof of a two story house. Flashing is needed where the shingles abut both the house and the roof of the garage.

Customarily, flashing is attached to the house one piece, or card, at a time. It is difficult for the roofer to hold the flashing cards and the shingles in place and achieve the desired security for the positioning of these elements. Furthermore, due to the variety of the thickness of shingles and the variety of types of materials which are used for shingles, it is difficult to simplify the attaching of flashing material during a roofing project.

While conventional approaches are commonly used, they suffer from several disadvantages. Perhaps the most important of these is that in spite of the great effort of the roofer to provide an effective seal, water still tends to seep in-between the flashing cards themselves and in-between the flashing cards and the shingles.

The desirability of simplifying the flashing attachment to a roof, thus, becomes clear. The problems in the art necessitate improvement in this field. It is to the solution of the above mentioned problems to which the present invention is directed.

SUMMARY OF THE INVENTION

The present invention discloses a prefabricated flashing strip for weatherproofing the intersection of an upright wall and a shingled roof, the strip comprising:

a plurality of partially overlapping adjacently disposed flashing cards, each of the plurality of partially overlapping adjacently disposed flashing cards having a substantially vertical portion and a substantially horizontal portion;

means for sealably mounting the vertical portion of each of the plurality of partially overlapping adjacently disposed flashing cards to the vertical portion of an adjacent flashing card, forming a substantially watertight seal therebetween; and wherein a shingle is slidably seated between the substantially horizontal portion of each of the plurality of partially overlapping adjacently disposed flashing cards.

The present invention provides a flashing strip which includes a plurality of flashing cards, each flashing card having a vertically oriented surface and a horizontally oriented surface. Each flashing card is partially overlappingly mounted to an adjacent flashing card at their vertically oriented surfaces to create the flashing strip of the present invention. This is accomplished by several methods including stapling and/or gluing the partially overlapping vertically oriented surfaces to one another.

The flashing strip of the present invention may be configured to have a specific length and may be sizeable by a roofer by removing one or more individual flashing cards from the flashing strip to meet the specific requirements of the job being performed.

The present invention will be more clearly understood with reference to the accompanying drawings and to the following detailed description, in which like reference numerals refer to like parts and where:

BRIEF DESCRIPTION OF THE DRAWINGS

FIG. 1 is a perspective view of a preferred embodiment of the present invention as employed with shingles;

FIG. 2 is a front plan view of a preferred embodiment of the present invention before the flashing cards have been folded;

FIG. 3 is a perspective view of a preferred embodiment in an unassembled state in accordance with the present invention including a patch of adhesive;

FIG. 4 is a perspective view of a preferred embodiment of the present invention in an unassembled state including a strip of adhesive;

FIG. 5 is a perspective view of a preferred embodiment of the present invention in an unassembled state including an adhesive bead;

FIG. 6 is a cross-sectional view of an embodiment of the present invention including a staple.

DETAILED DESCRIPTION OF THE PREFERRED EMBODIMENT

Referring now to FIGS. 1 and 2, there is depicted therein a preferred embodiment of a flashing strip 10 in accordance with the present invention. The flashing strip 10 includes a plurality of flashing cards 12 and means for bonding 14 each of the plurality of flashing cards 12 together.

Flashing cards are well-known in the art and are generally formed from a durable, pliable, and corrosive resistant material including, but not limited to plastic, Aero gel, aluminum, tin, etc. As currently produced, flashing cards measure approximately eight inches on a side, although other sizes and configurations may be used in the preferred embodiment of the present invention. Each of the plurality of flashing cards 12 has an upper portion 16, a lower portion 18, a front surface 20 and a rear surface 22.

Each of the plurality of flashing cards 12 overlaps an adjacent flashing card as depicted in FIG. 2. The flashing strip 10 has a first end 24 and a second end 26. The flashing card at the first end 24 is not overlapped by another flashing card. The flashing card at the second end 26 does not overlap another flashing card. Each of the overlapping flashing cards are mounted to an adjacent flashing card via the means for bonding 14 each of the plurality of flashing cards 12 together which will be described in more detail herein below.

As depicted in FIG. 2, the plurality of flashing cards 12, which are at first unbent, may be bent before or after they are mounted to one another. As it is easier to bend the flashing cards before they have been bonded to one another, this is the preferred time to do so. However, they may be bent after they are mounted to one another as well. FIG. 2, particularly shows a flashing strip 10 where the plurality of flashing cards 12 have not been bent. This makes storage very simple, the task remains to bend the cards. Means for bending flashing cards includes the use of pliers, hands, a cornered surface or other simple tools to create approximately a ninety degree angle between the top portion 16 and the bottom portion 18 of each of the plurality of flashing cards 12. The angle between the subbstantially vertical portion and the substantially horizontal portion may range from about 1° to 180°. However, a 90° angle is generally employed in the art under most circumstances.

Once each of the plurality of flashing cards has been bent, they must be bonded to one another. The individual flashing cards may be attached to one another by a variety of novel means. For the purpose of example, several preferred mounting configurations are depicted in FIGS. 3–6.

Preferably, and as depicted in FIG. 3, each of the plurality of flashing cards 12 that is to be bonded to an adjacent card will have a patch of adhesive 28 included on a portion of its front surface 20 at its upper portion 16. The adhesive should be substantially waterproof and may be a glue, patch having adhesive on both sides thereof, or two sided tape. One such adhesive which may be used is sold under the name 9u High Strength Adhesive manufactured by the 3M Company. The patch of adhesive 28 is preferable because of the amount of water sealing protection it provides against water seepage between individual flashing cards and because it may be easily applied to the individual flashing cards. If such an adhesive patch 28 is not employed, another preferred bonding configuration is depicted in FIG. 4, namely an adhesive strip 30. The adhesive strip 30 may be glue, or a very thin piece of material having glue applied on both sides thereof or even two sided tape. The adhesive strip 30 does not provide quite as much water protection as the adhesive patch 28, but it will still preclude the seepage of water in between the substantially vertical portions of the individual flashing cards of the flashing strip 10 of the present invention.

If one does not use either the adhesive patch 28, or the adhesive strip 30, an adhesive bead 32 or a plurality thereof may be employed, as depicted in FIG. 5. The adhesive bead 32 may be a drop of glue, or once again a small piece of material that itself has been soaked in glue. Obviously an adhesive bead will provide less water seepage protection than the adhesive strip 30 or the adhesive patch 32, however, there are climates where the adhesive bead 32 would be appropriate, namely those climates where rainfall is minimal.

It is to be additionaly appreciated that one of the advantages of the present invention is the stability of the flashing strip 10. A workman may carry around a flashing strip 10 in accordance with the present invention without it flopping about which might prove troublesome, and even dangerous while the roofer works upon a roof.

FIG. 6 depicts two flashing cards mounted to one another via a staple 34. The staple 34 may be used conjointly with any of the other means for bonding 14 each of the plurality of flashing cards 12 together that have already been herein described, or it may be used alone. The staple 32 provides two points of attachment between each of the partially overlapping adjacently disposed flashing cards. This adds stability to the flashing strip 10 of the present invention.

The individual flashing cards which make up the flashing strip 10 of the present invention are overlappingly mounted at their respective upper portions 16 and provide, preferably, between 1 and 7 inches of overlap between consecutive flashing cards. Thus, the size of the adhesive patch 28, adhesive strip 30, or the number of adhesive beads 32 employed is dependent upon the amount of overlap between consecutive flashing cards.

As an example, if one desired to manufacture a roof that included many small shingles, the flashing strip would, preferably, have individual flashing cards that overlapped 5–7 inches. In this way, more shingles may be placed upon the roof, which is necessary, due to the small size of the shingles. If the shingles were exceptionally large, say, on the order of 18 inches each, then the flashing strip would have the individual flashing cards overlapping between 1 and 4 inches. Intermediate size shingles may also be used with the flashing strip, which is one of the advantageous features of the present invention. As depicted in FIG. 1, each shingle 36 is slidably seated with its bottom surface 38 atop the substantially horizontal lower portion 18 of a flashing card 12 and one edge 40 of the shingle 36 abutting the substantially vertical upper portion 16 of the flashing card 12.

The flashing strip of the present invention provides several advantages over currently available flashing cards and flashing systems. It is easy to use at a job site and is especially simple to store. The flashing strip 10 of the present invention provides protection against water damage to a home by providing environmental sealing between each of the individual flashing cards. Additionally, the flashing strip of the present invention is extremely stable.

While the invention has been illustrated and described in detail in the drawings and the foregoing description, the same to be considered as illustrative and not restrictive in character, it being understood that only the preferred embodiment has been shown and described and that all changes and modification that come within the spirit of the invention are desired to be protected.

Having thus described the present inventor, what is claimed is:

1. A prefabricated flashing strip system for weatherproofing intersection of upright wall and a shingled roof, the system comprising:

a plurality of partially overlapping adjacently disposed flashing cards, each of the plurality of partially overlapping adjacently disposed flashing cards having a substantially vertical portion and a substantially horizontal portion;

a sealings, watertight adhesive interposed between adajacent flashing cards for sealably mounting the vertical portion of each of the plurality of partially overlapping adjacently disposed flashing cards to the vertical portion of an adjacent flashing card, forming a substantially watertight seal therebetween; and wherein a shingle is slidably seated between the substantially horizontal portion of each of the plurality of partially overlapping adjacently disposed flashing cards.

2. The flashing strip of claim 1 wherein the adhesive for sealably mounting the vertical portion of each of the plurality of partially overlapping adjacently disposed flashing cards to the vertical portion of an adjacent flashing card is an adhesive patch.

3. The flashing strip of claim 1 wherein the adhesive for sealably mounting the vertical portion of each of the plurality of partially overlapping adjacently disposed flashing cards to the vertical portion of an adjacent flashing card is an adhesive strip.

4. The flashing strip of claim 1 wherein the adhesive for sealably mounting the vertical portion of each of the plurality of partially overlapping adjacently disposed flashing cards to the vertical portion of an adjacent flashing card is an adhesive bead.

5. The flashing strip of claim 1 wherein the adhesive for sealably mounting the vertical portion of each of the plurality of partially overlapping adjacently disposed flashing cards to the vertical portion of an adjacent flashing card is a plurality of adhesive beads.

6. The flashing strip of claim 2 wherein the adhesive for sealably mounting the vertical portion of each of the plurality of partially overlapping adjacently disposed flashing cards to the vertical portion of an adjacent flashing card further is a staple.

7. The flashing strip of claim 3 wherein the adhesive for sealably mounting the vertical portion of each of the plurality of partially overlapping adjacently disposed flashing cards to the vertical portion of an adjacent flashing card further is a staple.

8. The flashing strip of claim 4 wherein the adhesive for sealably mounting the vertical portion of each of the plurality of partially overlapping adjacently disposed flashing cards to the vertical portion of an adjacent flashing card further is a staple.

9. The flashing strip of claim 5 wherein the adhesive for sealably mounting the vertical portion of each of the plurality of overlapping adjacently disposed flashing cards to the vertical portion of an adjacent flashing card further is a staple.

* * * * *